United States Patent [19]

Robertsson

[11] 3,955,292

[45] May 11, 1976

[54] APPARATUS FOR ANTIAIRCRAFT GUNNERY PRACTICE WITH LASER EMISSIONS

[75] Inventor: Hans R. Robertsson, Molndal, Sweden

[73] Assignee: Saab-Scania Aktiebolag, Linkoping, Sweden

[22] Filed: Nov. 18, 1974

[21] Appl. No.: 524,826

[30] Foreign Application Priority Data

Nov. 19, 1973 Sweden ..... 7315588

[52] U.S. Cl. ..... 35/25

[51] Int. Cl.[2] ..... F41C 27/00

[58] Field of Search ..... 35/25; 89/41 L; 343/5 DP; 273/101.1

[56] References Cited

UNITED STATES PATENTS

| | | | |
|---|---|---|---|
| 3,339,293 | 9/1967 | Kuhlo et al. | 35/25 |
| 3,588,108 | 6/1971 | Ormiston | 35/25 X |
| 3,797,014 | 3/1974 | Tompkins et al. | 343/5 DP |
| 3,798,795 | 3/1974 | Michelsen | 35/25 |
| 3,813,795 | 6/1974 | Marshall et al. | 35/25 |
| 3,832,791 | 9/1974 | Robertsson | 35/25 |

*Primary Examiner*—G. E. McNeill
*Assistant Examiner*—John H. Wolff

[57] ABSTRACT

Each gun of an antiaircraft battery has a unit comprising a laser and a coaxial radiation detector, the axis of the unit being near and parallel to that of the gun barrel. An instrument center, spaced from the guns and controlling their aim, comprises a central sight for target tracking and means for calculating an aiming-off point at which the guns should be aimed when firing real projectiles. For laser practice, projectile flight time is set equal to zero by a switch at the center, so that with correct firing preparations each gun points to a tracked target for detection of laser emissions reflected from it. The laser emits a pulse train for each shot. Hits are scored only on detected trains having a predetermined minimum number of pulses, and scoring is weighted according to error probabilities that would affect real hit results.

9 Claims, 15 Drawing Figures

FIG. 12.

| SHOT NO. | T/M | R | a | f | P | S | V |
|---|---|---|---|---|---|---|---|
| 01 | T | 2700 | 6 | 2 | 0.04 | 0.21 | 0 |
| 02 | T | 2670 | 6 | 2 | 0.04 | 0.40 | 0 |
| 03 | B | — | — | — | — | — | 0 |
| 04 | B | — | — | — | — | — | 0 |
| 05 | B | — | — | — | — | — | 0 |
| 06 | T | 2550 | 6 | 0 | 0.02 | 0.05 | 0 |
| 07 | B | — | — | — | — | — | 0 |
| 08 | B | — | — | — | — | — | 0 |
| 09 | B | — | — | — | — | — | 0 |
| 10 | T | 2420 | 6 | 1 | 0.03 | 0.77 | 0 |
| 11 | B | — | — | — | — | — | 0 |
| 12 | T | 2360 | 5 | 4 | 0.06 | 0.96 | 0 |
| 13 | T | 2330 | 5 | 5 | 0.07 | 0.73 | 0 |
| 14 | T | 2300 | 5 | 4 | 0.06 | 0.32 | 0 |
| 15 | B | — | — | — | — | — | 0 |
| 16 | T | 2230 | 5 | 5 | 0.07 | 0.46 | 0 |
| 17 | T | 2200 | 5 | 6 | 0.08 | 0.06 | 1 |
| 18 | T | 2160 | 5 | 6 | 0.08 | 0.52 | 0 |
| 19 | T | 2140 | 5 | 7 | 0.09 | 0.65 | 0 |
| 20 | T | 2110 | 5 | 6 | 0.08 | 0.13 | 0 |
| 21 | T | 2090 | 5 | 6 | 0.08 | 0.28 | 0 |
| 22 | T | 2060 | 5 | 4 | 0.06 | 0.80 | 0 |
| 23 | B | — | — | — | — | — | 0 |
| 24 | T | 2000 | 5 | 1 | 0.03 | 0.03 | 1 |

FIG. 13.

| SHOT NO. | T/M | Δf | f |
|---|---|---|---|
| 13 | T | 0 | |
| 14 | T | 0.5 | |
| 15 | B | 0 | |
| 16 | T | 2 | |
| 17 | T | | 6 |
| 18 | T | 2 | |
| 19 | T | 1 | |
| 20 | T | 0.5 | |
| 21 | T | 0 | |

FIG. 14.

| RANGE-METERS | a |
|---|---|
| 0 – 399 | 0 |
| 400 – 799 | 1 |
| 800 – 1199 | 2 |
| 1200 – 1599 | 3 |
| 1600 – 1999 | 4 |
| 2000 – 2399 | 5 |
| 2400 – 2799 | 6 |
| 2800 – 3199 | 7 |
| 3200 – 3599 | 8 |
| 3600 – 3999 | 9 |
| 4000 – 4399 | 10 |
| 4400 – 4799 | 11 |
| 4800 – 5199 | 12 |
| 5200 – 5599 | 13 |
| 5600 – 5999 | 14 |
| 6000 – 6399 | 15 |

FIG. 15.

| a | f | P | a | f | P |
|---|---|---|---|---|---|
| 3 | 0 | 0.04 | 6 | 0 | 0.02 |
| | 1 | 0.06 | | 1 | 0.03 |
| | 2 | 0.09 | | 2 | 0.04 |
| | 3 | 0.11 | | 3 | 0.04 |
| | 4 | 0.14 | | 4 | 0.05 |
| | 5 | 0.20 | | 5 | 0.05 |
| | 6 | 0.22 | | 6 | 0.06 |
| | 7 | 0.24 | | 7 | 0.06 |
| ⋮ | ⋮ | ⋮ | ⋮ | ⋮ | ⋮ |
| 5 | 0 | 0.02 | 8 | 0 | 0.02 |
| | 1 | 0.03 | | 1 | 0.02 |
| | 2 | 0.04 | | 2 | 0.02 |
| | 3 | 0.05 | | 3 | 0.03 |
| | 4 | 0.06 | | 4 | 0.03 |
| | 5 | 0.07 | | 5 | 0.03 |
| | 6 | 0.08 | | 6 | 0.04 |
| | 7 | 0.09 | | 7 | 0.04 |

APPARATUS FOR ANTIAIRCRAFT GUNNERY PRACTICE WITH LASER EMISSIONS

This invention relates to apparatus for scoring antiaircraft gunnery target practice with the use of laser emissions that simulate the firing of projectiles; and the invention is more particularly concerned with apparatus which can be very quickly converted from use with laser emissions to use with real projectiles, and vice versa.

An antiaircraft battery usually consists of one or more weapons connected with an instrument center that may be at some distance from the weapons. At the instrument center, which serves as a command post, tracking apparatus is employed to acquire data concerning the positions and courses of target aircraft, and such data are used to calculate the aim required for each weapon in the battery.

As is well known, when a weapon is fired at a moving target that is some distance away and has a substantial component of velocity transverse to the barrel axis of the weapon, the weapon must be aimed with a certain amount of lead on the target, so that at the instant of firing the weapon is shooting at a point which is actually ahead of the target and at which the target and the projectile will arrive simultaneously. The point at which the weapon is thus aimed is herein referred to as the aiming-off point.

At the instrument center, calculating apparatus cooperates with the tracking apparatus to calculate the azimuth and elevation angles for aiming each weapon in the battery at a correct aiming-off point. Outputs corresponding to those aiming angles are transmitted over cables to the respective weapons, or, more specifically, to servo means for each weapon by which the aiming of the weapon is effected mechanically.

Because the weapons are at some distance from the instrument center, the aiming outputs to the weapon servos must be corrected for parallax, and such parallax correction is also calculated by the apparatus at the instrument center. However, the accurate calculation of the parallax correction is dependent upon exact measurements of distances and bearings between the respective weapons and the instrument center. The taking of such measurements constitutes a part of the necessary preparation for firing of the battery, and consequently the crew in charge of the battery must be trained in parallax field measurements, as well as in the levelling and parallel orientation of the guns of the battery and the more immediate preparations for firing that include tracking a target and loading and firing of the guns.

At least a certain amount of the training of the antiaircraft battery personnel should desirably occur under simulated combat conditions, in which the troops, or a building or the like that they are assigned to defend, are subjected to mock aerial attack by target aircraft and in which the troops load the guns of the battery with blank ammunition.

Although firing accuracy of an antiaircraft battery can be tested and scored by having the battery fire live ammunition at pilot-less drone aircraft or the like, such exercises have only limited value. The use of live ammunition requires that such target practice be carried out on an unpopulated firing range, rather than in the vicinity of buildings that would have to be defended in an actual state of war; hence such target practice does not satisfactorily simulate conditions of defense against an actual air attack. On the other hand, there has heretofore been no satisfactory expedient for evaluating the state of training of antiaircraft battery personnel operating under realistically simulated combat conditions at a site which they might actually have to defend. In the past, efforts have been made to evaluate the hit probabilities of the guns in such an exercise on the basis of results obtained by the personnel during previous target practice with live ammunition. In such evaluation, the distance from the instrument center to the aiming-off point, measured at the commencement of firing, was taken as the only critical value. Such estimation methods were of course inaccurate, especially since they usually had to be made on the assumption that there had been correct execution of all of the firing preparations and of tracking of the target at the instrument center.

To check on tracking accuracy, the central sight at the instrument center was sometimes provided with binoculars or a TV camera, to permit scoring officers to observe the target and the tracking of it. However, those expedients, although expensive and somewhat awkward, still enabled nothing more than an estimate to be made of tracking accuracy.

To check on whether or not other firing preparations had been properly and accurately made, scoring officials could only monitor such preparations in detail or repeat them for themselves. Such checks were of course time consuming, and unless they were made rather hastily, so that accuracy was questionable, they tended to create unrealistic and burdensome delays in the progress of the exercise.

By contrast, it is a general object of the invention to provide apparatus by which objective and accurate scoring data can be obtained that reflects the performance of an antiaircraft battery during a simulated aerial attack in which no live ammunition is used by either the attacking or the defending forces, and whereby hit-or-miss data can be obtained almost immediately after each simulated salvo is fired by the battery, which data accurately correlates with the actual state of training of the battery personnel in that it reflects the skill with which firing preparations were performed, the accuracy of target tracking, and whether or not the firing operations were properly executed.

It is also a general object of this invention to provide apparatus that enables the state of training of an antiaircraft battery crew to be objectively evaluated under simulated combat conditions, and which is capable of presenting a score that is in effect a summation of all aspects of the state of training of the crew.

Another and more particular object of the invention is to provide scoring apparatus of the character just described that is in the nature of auxiliary equipment capable of being fitted to existing antiaircraft weapons and the control apparatus for the same, and which does not interfere with performance of normal, live-ammunition firing by the battery and provides for almost instant conversion from simulated firing for scoring purposes to firing or real projectiles, and vice versa.

Another specific object of the invention is to provide scoring apparatus of the character described wherein laser emissions are used to simulate the firing of a weapon and wherein scoring is reliably based upon laser pulses emitted towards a target and reflected back from it, without interference from light flashes from extraneous sources.

A further and very important object of the invention is to provide a method and means for scoring the hit-and-miss results obtained during the simulated firing of an antiaircraft battery with laser emissions, wherein compensation is made for all significant differences between laser emissions and real projectiles, including those peculiarities in results obtained with real projectiles that are predictable only on a probability basis.

With these observations and objectives in mind, the manner in which the invention achieves its purpose will be appreciated from the following description and the accompanying drawings, which exemplify the invention, it being understood that changes may be made in the precise method of practicing the invention and in the specific apparatus disclosed herein without departing from the essentials of the invention set forth in the appended claims.

The accompanying drawings illustrate one complete example of an embodiment of the invention constructed according to the best mode so far devised for the practical application of the principles thereof, and in which.

Figure 11:
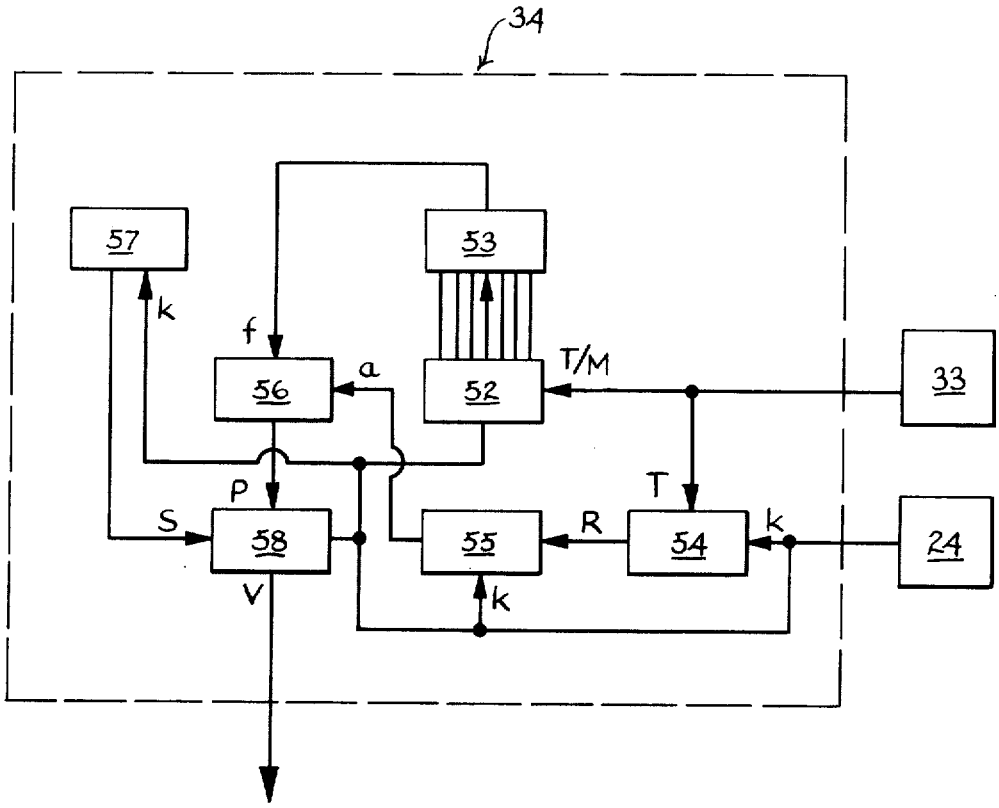

FIG. 11 is a simplified block diagram of the apparatus by which the reflected and detected laser emissions are processed to make a calculation of the probability that a hit would have been scored on a target from which the laser emissions were reflected, assuming that a corresponding firing had occurred with a real projectile; and FIGS. 12–15 are tables showing examples of the logic processing that takes place in the apparatus illustrated in FIG. 11.

Referring now to the accompanying drawings, the number 1 designates an antiaircraft weapon which is emplaced near a building 2 to defend the same against air attack, and which is connected by means of an electrical cable 3 with a command post or instrument center 4. In general, the instrument center acquires information about the instantaneous position, speed and direction of motion of a target aircraft 7, makes calculations of the aim required of the weapon for a hit on the target, and issues outputs over the cable 3 to servo means 8 at the weapon whereby the weapon barrel is aimed in accordance with the calculations. Loading and firing of the weapon is done by personnel located at the weapon, under the command of an officer at the instrument center.

Tracking of a target aircraft, to acquire position, speed and direction data on it, is accomplished with the use of a central sight at the instrument center. That sight is of known construction and therefore it is not shown in detail. It can comprise a periscope 5, used for direct visual tracking, and radar apparatus which is signified by a radar antenna 6 and which can be used for automatic target tracking. The central sight is movable both in elevation (vertically) and in azimuth (laterally), and the barrel of the weapon is likewise moved in elevation and in azimuth by its servo means 8.

When real projectiles are to be fired from the weapon 1, the calculating apparatus at the instrument center, which is described hereinafter, must calculate an aiming-off point Ffp which is ahead of the instantaneous position of the target aircraft by a distance which depends upon the speed and direction of motion of the target aircraft and the finite flight time required for a projectile to move along its trajectory from the gun to the target. The calculating apparatus at the instrument center must also take account of the relative bearings between the weapon and the instrument center and their distance from one another, so that the weapon is aimed with the necessary correction for parallax.

The parallax correction must be made under all circumstances, and its accuracy will of course be dependent upon the accuracy of the data used in calculating it; that is, the parallax correction will be as accurate as the distance and bearing measurements made by the battery personnel during their preparations for firing. The present invention contemplates the use of laser emissions emanating from the weapon, directed substantially along its barrel axis and reflected back to the weapon from the target, as a means for scoring firing accuracy. It will be apparent that the laser emissions will be reflected back from the target to the weapon only if the weapon, at the instant of firing, is aimed at the then-existing position of the target. To this end the invention contemplates that the aiming-off position will be calculated on the basis of a zero flight time of the projectile and will therefore coincide with the target position. The scoring results thus obtained will depend upon the accuracy of the parallax correction as well as upon other firing preparations and tracking accuracy, and such scoring results will thus represent a summation of the state of training of the battery crew in all respects.

Of course the zero time of projectile flight is used for practice with laser radiation because of the infinitesimal time needed for light to travel from the weapon to the target and back to the weapon. Before explaining the novel expedient by which the invention enables the aiming-off point to be equated with the instantaneous position of the target, the installation of the laser transmitting and receiving apparatus on the weapon will first be described.

Figure 7:
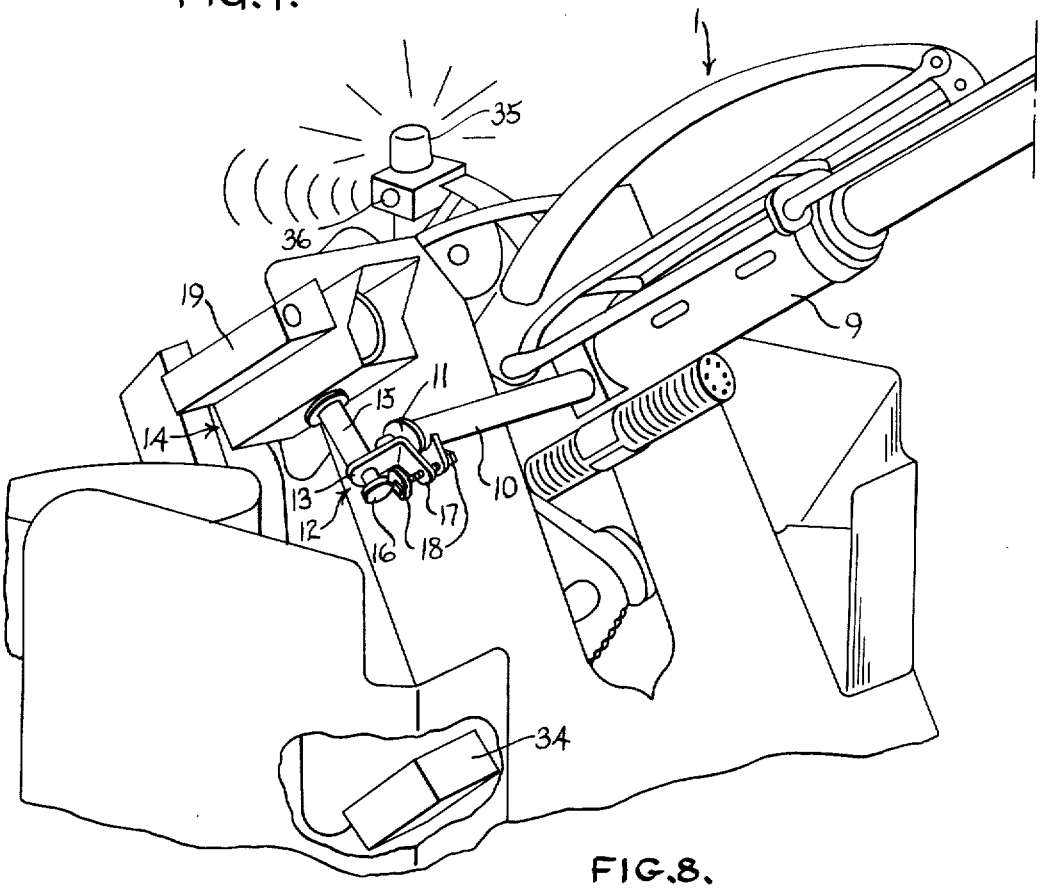
FIG. 7 is a fragmentary perspective view of an antiaircraft gun equipped with apparatus embodying the principles of this invention, for simulating firing against a target by emission of laser pulses and for detecting laser emissions reflected back from the target.

As shown in FIG. 7, there is fixed to the barrel 9 of the gun a tubular spar 10 which has its axis at right angles to that of the gun barrel and which projects to one side of the barrel. The spar 10 is spaced a short distance forwardly of the gimbal axes about which the gun barrel swings for its aiming movements in elevation and azimuth. At the outer end of the spar there is a rotary bearing 11 which has its axis of rotation concentric with the axis of the spar. An angle bracket 12, attached to the movable part of the rotary bearing, has one leg 13 which extends parallel to the bearing axis and another leg 17 that extends transversely to it. To the leg 13 of the bracket 12 there is rotatably secured the lower end of a shaft 15 that has its axis at right angles to the bearing axis. A combined laser emitter-receiver unit 14 is fixed to the upper end of the shaft 15. The emitter-receiver unit 14 has its emission axis perpendicular to the axis of the shaft 15, and hence that unit is adjustable in azimuth directions, relative to the gun barrel 9, inasmuch as it can rotate with the shaft 15 about the axis of that shaft. However, a locking hand screw 16 is arranged to releasably lock the shaft 15 to the bracket leg 13 in any position of rotation of the shaft, thus enabling the laser unit 14 to be fixed in any desired position of azimuth adjustment relative to the gun barrel 9.

In like manner, the unit 14 can be adjusted in elevation relative to the barrel, inasmuch as it can swing about the axis of the bearing 11. However, the downwardly extending leg 17 of the L-shaped bracket 12 can be clampingly confined between a pair of locking screws 18, each threaded through a bracket fixed on the spar 10, to be held in any desired position of elevation adjustment by those screws.

In general, the axis of the emitter-receiver unit will be adjusted to be exactly parallel to the axis of the gun barrel, inasmuch as the distance between those axes is so small relative to target size and the other distances involved that the two axes can be regarded as coinciding for practical purposes. In cases where parallax compensation is necessary, it can be effected easily because of the adjustability of the laser unit 14, as described above. To facilitate such adjustments, the laser unit is preferably provided with a telescopic sight 19.

Note that the presence of the laser unit 14 offers no interference to use of the weapon for firing real projectiles or blank ammunition.

Figure 8:
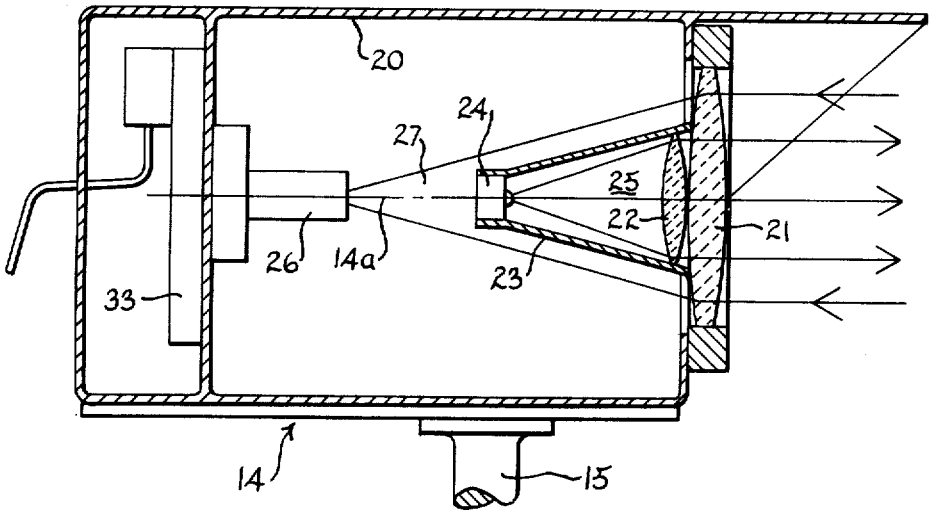
FIG. 8 is a somewhat diagrammatic longitudinal sectional view through the laser pulse emitter/receiver shown in FIG. 7.

As shown in FIG. 8, the emitter-receiver unit 14 is enclosed in a protective housing 20 that has, at its front, a pair of lenses 21 and 22 of different diameters, arranged concentrically, one behind the other. In the middle of the housing is mounted a laser beam emitter 24, enclosed in a frustoconical case 23 that is coaxial with the lenses. The smaller lens 22 closes the divergent front end of the emitter case 23, and laser radiations therefore pass through both of the lenses. The receiver 26, which detects radiation reflected back from the target, is mounted at the rear of the unit housing 20, behind the emitter 24 and concentric with it. The return radiation enters the housing 20 through the annular portion of the larger lens 21 that is radially outward of the lens 22, and in passing through that annular lens portion the return radiation is convergingly brought to a focus upon the receiver 26, which of course comprises a photoresponsive device.

Figure 1:
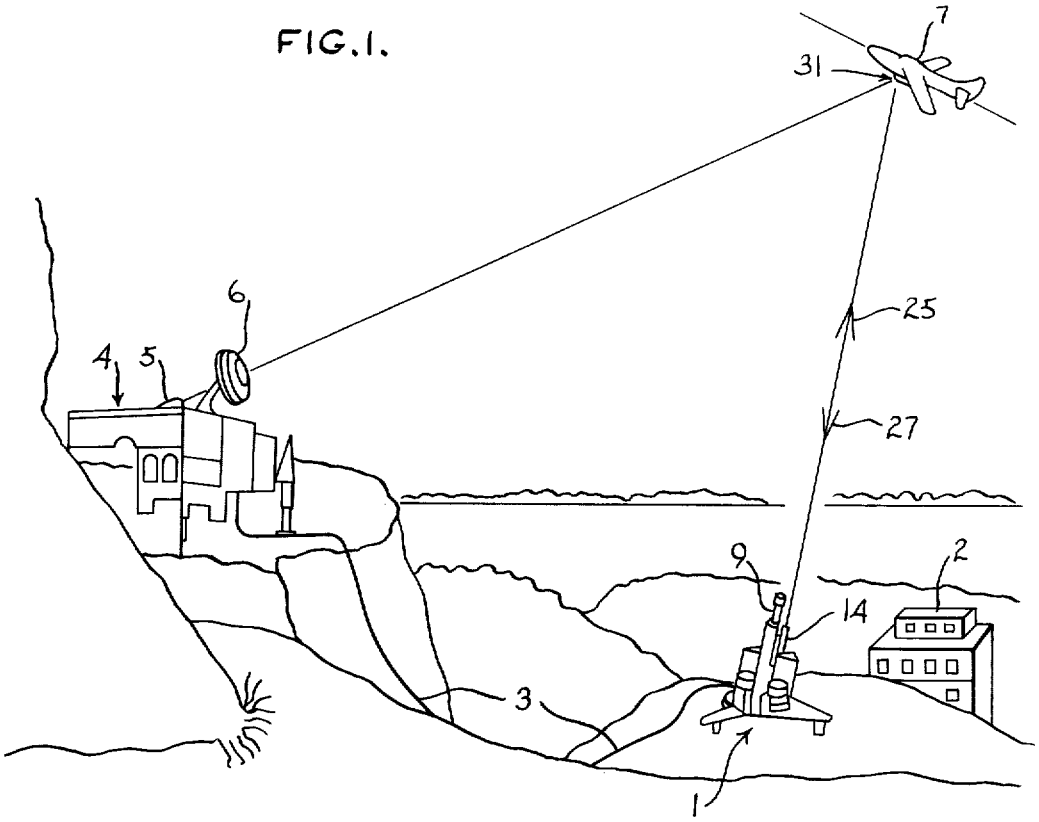
FIG. 1 is a perspective view of an antiaircraft weapon shown in its relation to an instrument center that controls it, a building that it is intended to defend, and a target aircraft which is making a simulated attack upon the building.
Figure 2:
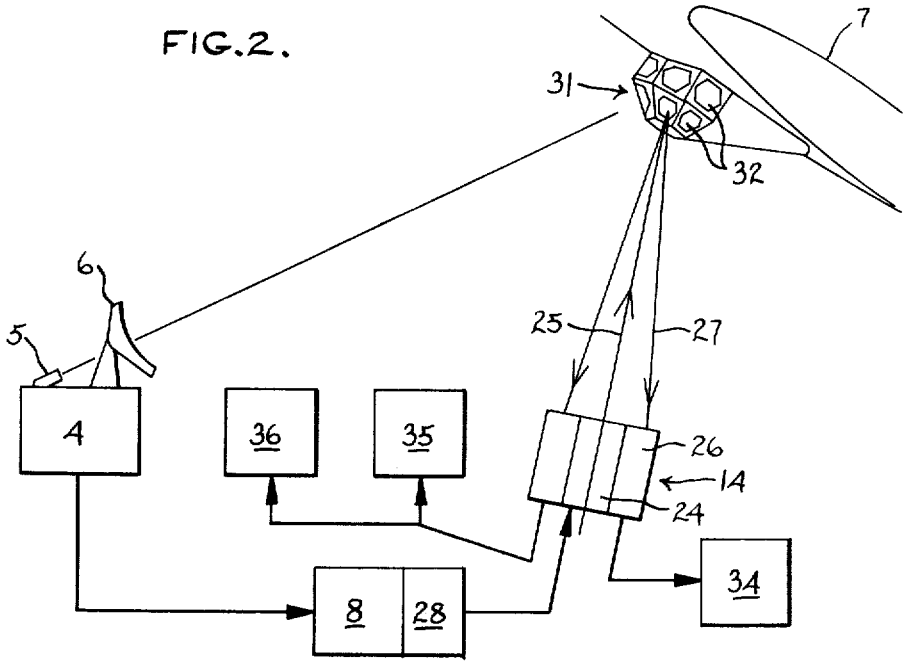
FIG. 2 is a block diagram of the main elements of the apparatus of this invention and their interconnections with one another.
Figure 9:
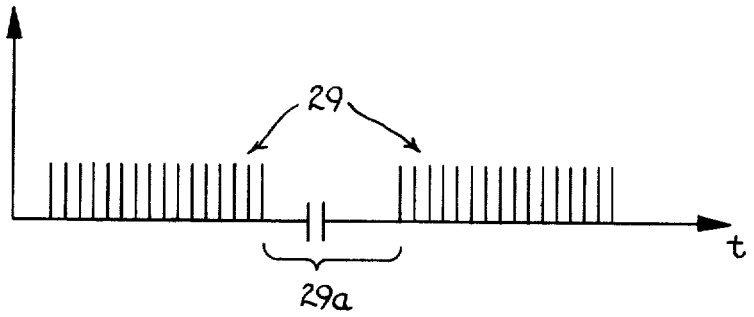
FIGS. 9 and 10 are diagrams which respectively show trains of laser pulses radiated by the laser emitter and corresponding pulse trains detected by the receiver.

The laser emitter 24 is connected in a known manner with the firing mechanism 28 of the gun (see FIG. 2) and is so arranged that each actuation of that mechanism for the firing of a projectile causes the emitter to radiate a train 29 of laser pulses (see FIG. 9). Each such pulse train comprises a predetermined number of brief pulses of radiation, following one another in rapid succession. In the example illustrated in FIG. 9, there are sixteen pulses in each such train. The duration of each pulse train is so short that the intervals **29*a*** between successive pulse trains are substantially longer than the pulse trains themselves; which is to say that each pulse train occupies only a small part of the time interval between the firing of a pair of successive shots from the gun.

Attached to the target aircraft is a reflector 31 comprising a plurality of retro-reflecting prisms 32 arranged to face in different directions and each of which reflects light exactly oppositely to the direction of its incidence, so that laser emissions reaching the target are reflected back to the weapon from which they came. The aircraft may be equipped with two or more such reflectors to insure that laser emissions from any position will strike at least one of the reflectors regardless of the attitude of the aircraft.

The laser radiation receiver 26 comprises a detecting unit 33 which is adapted to record the number of received pulses 37, 38, 39 (see FIG. 10) in any received pulse train and which, therefore, obviously comprises a counting device. If the number of pulses so received is equal to or greater than a predetermined number, the detect-unit 33 can issue a "hit" output to an indicating device which is illustrated in FIG. 7 as comprising an indicator light 35 and a buzzer 36, both mounted on the weapon 1. The perceptible signals issued from the indicating device immediately inform the crew of the results they have attained and thus make for more effective training than the delayed scoring results obtained with prior systems. It will be understood that suitable hit indicating means can be located at the instrument center in addition to, or instead of, those mounted on the gun carriage.

Figure 10:
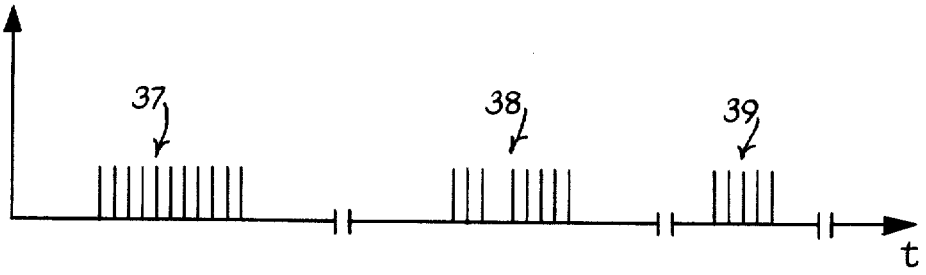

If the number of pulses detected in a received pulse train is less than the predetermined number, the indicating device issues no "hit" indication. In the example shown in FIGS. 9 and 10, wherein each transmitted pulse train consists of sixteen pulses, at least eight pulses must be detected in a received pulse train in order for a "hit" to be signaled. Hence each of the received pulse trains 37 and 38 illustrated in FIG. 10 gives rise to a "hit" indication, but the pulse train 39 signifies a miss. Because a certain minimum number of pulses must be detected for a "hit" indication, the apparatus is insensitive to light from extraneous sources such as sun glints and lightning flashes. If only a very few return pulses of an emitted pulse train are detected, a corresponding shot with a real projectile would have resulted in a near miss, and the absence of a "hit" indication is appropriate.

Figure 6:
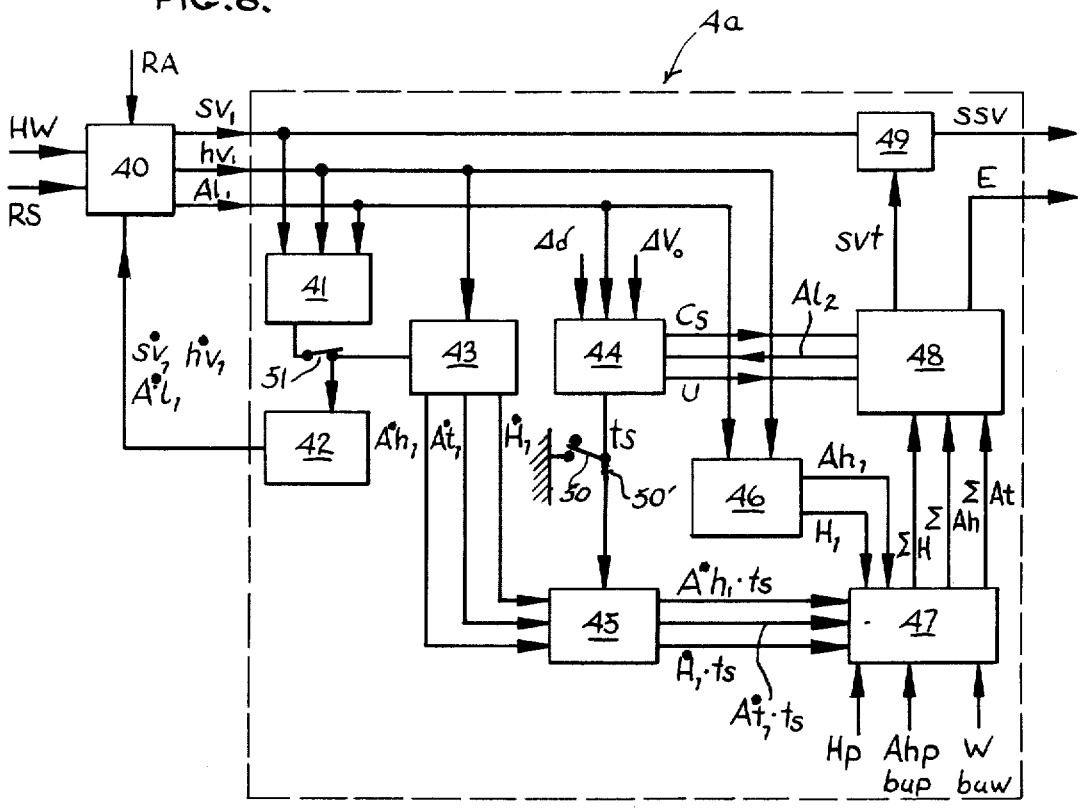
FIG. 6 is a simplified block diagram of the apparatus for calculating the aiming-off point.

Turning back now to the apparatus at the instrument center, which is diagrammatically illustrated in FIG. 6, it comprises a tracking control means 40 that can be responsive either to manually produced inputs RS or to signals RA produced by radar apparatus. In most cases radar will be used to acquire data concerning the distance $Al_1$ between the instrument center and the target along a straight line through them, and when the target is being manually tracked, such distance data can be fed into the control means 40 as an input HW from a hand wheel (not shown). The tracking control 40 must also provide outputs corresponding to azimuth angle $sv_1$ and elevation angle $hv_1$, which, together with the distance $Al_1$, define the instantaneous position of the target relative to the instrument center. During manual tracking, the angle data inputs are provided in the form of the signals RS produced by an aligning lever; during radar tracking such angle data are obtained as the inputs RA from the radar apparatus.

There is a feedback connection from certain of the calculating apparatus, through a switch 51, that enables a servo mechanism to effect automatic control of tracking when said switch is closed, to facilitate the tracking operation. The switch 51 will normally be in its open position during the target acquisition phase preceding actual tracking.

Figure 3:
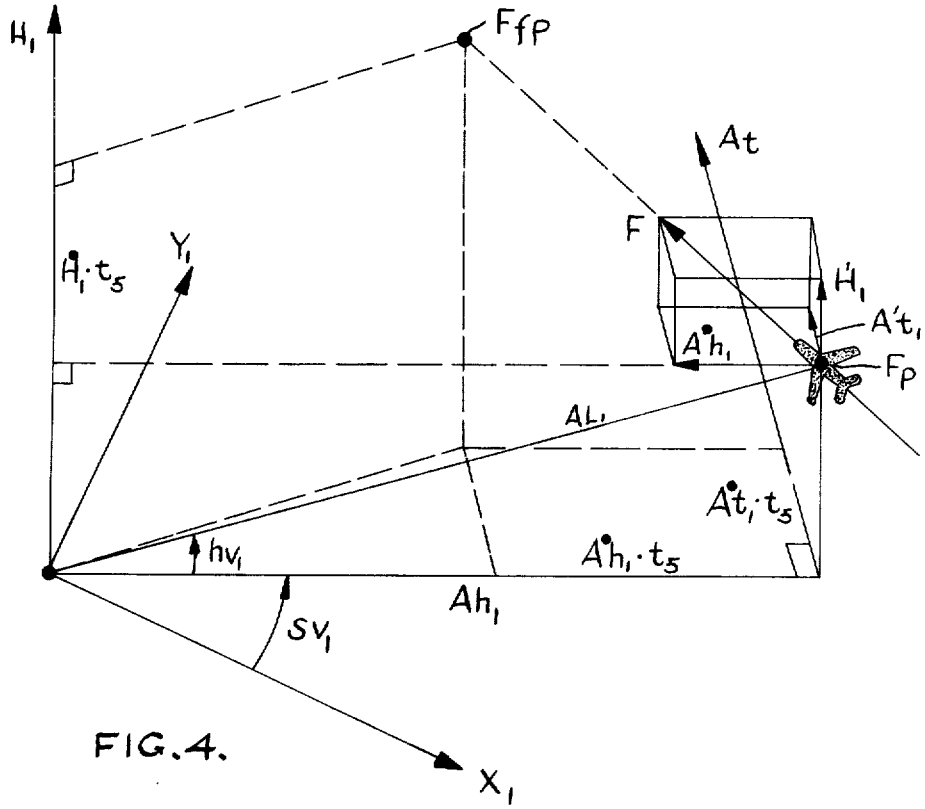
FIG. 3 illustrates and identifies various geometrical relationships between the instrument center and a target aircraft, used in calculating the position of the aiming-off point.
Figure 4:
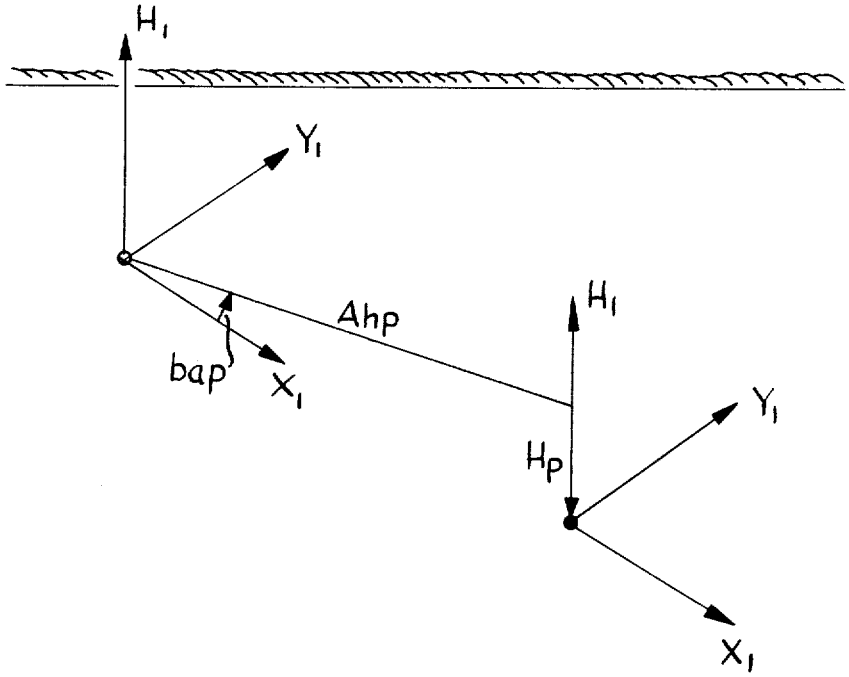
FIG. 4 illustrates and identifies certain geometrical relationships between the instrument center and a weapon controlled thereby.
Figure 5:
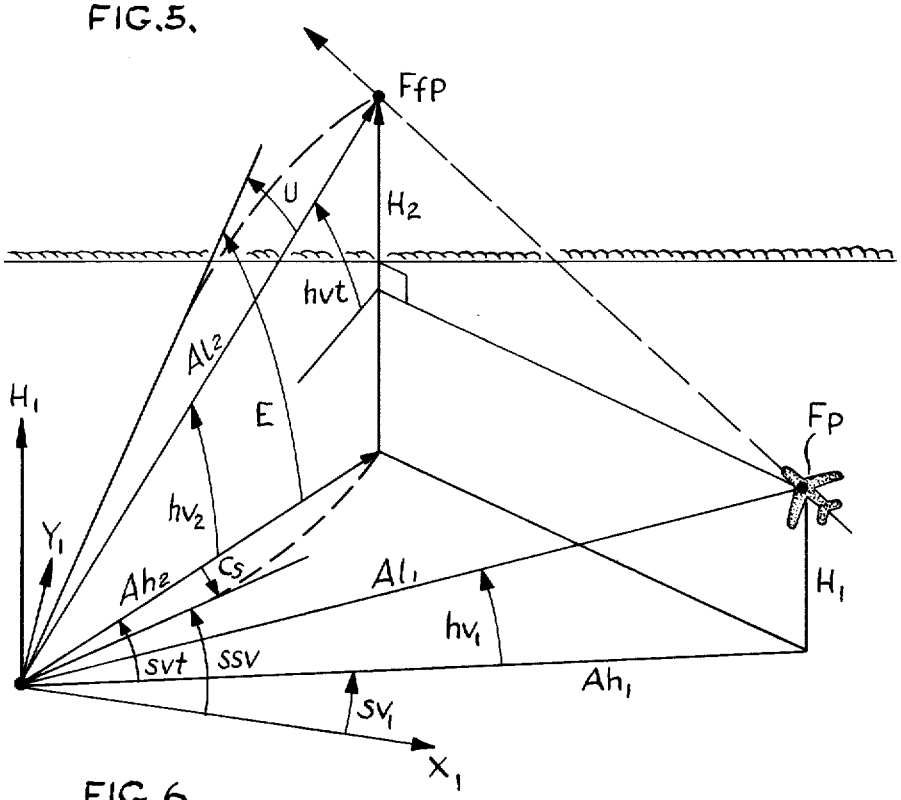
FIG. 5 illustrates and identifies certain geometrical relationships between the weapon and the target aircraft.

The calculating apparatus comprises a number of computers and counters 41–49, each of which is in itself a known device operating in a known manner. The magnitudes that are acquired and calculated during the tracking process are set forth in the following table, are illustrated by FIGS. 3–5, and are calculated as indicated in FIG. 6. All magnitudes are related to a coordinate system having its origin at the instrument center and having mutually perpendicular *x*, *y* and *h* axes, of which the *h* axis is vertical and the positive *x* axis extends along the north cardinal of the compass.

| | Geometrical and Ballistic Designations Illustrated in FIGS. 3–6 |
|---|---|
| $Al_1$ | — Distance between instrument center and target aircraft 7, measured along a straight line through them. |
| $Ah_1$ | — Horizontal projection of line $Al_1$. |
| $sv_1$ | — Azimuth angle between x axis and the horizontal projection $Ah_1$. |
| $hv_1$ | — Tracking elevation angle; i.e., angle between the distance line $Al_1$ and the horizontal plane containing the x and y axes. |
| $\dot{Ah}_1$ | — The velocity of the target in the $Ah_1$ direction, equal to the time derivative $dAh_1/dt$. |
| $\dot{At}_1$ | — The velocity of the target perpendicular to $Ah_1$. |
| $X_1$) $Y_1$) $H_1$) | — The position of the target along the x, y and h axes, respectively, of the instrument center coordinate system. |
| $\dot{H}_1$ | — The velocity of the target in the h direction. |
| $Ah_p$ | — The parallax in the Ah direction. |
| $H_p$ | — The parallax in the h direction. |
| bap | — Bearing measured from the instrument center to the gun. |
| Fp | — The firing point; i.e., the position of the target at the instant of firing. |
| At | — The direction of a horizontal line perpendicular to $Ah_1$ and through a point directly below $F_p$ (equals $sv_1 + 90°$). |
| Ffp | — The aiming-off point |
| $Al_2$ | — Distance between instrument center and aiming-off point Ffp along a straight line through them. |
| $Ah_2$ | — Horizontal projection of line $Al_2$. |
| $hv_2$ | — Aiming-off elevation angle, i.e., angle between $Al_2$ and the horizontal plane containing the x and y axes. |
| $H_2$ | — Vertical distance between the x-y plane and Ffp. |
| svt | — Azimuth angle increment; i.e., angular difference between $Ah_1$ and $Ah_2$. |
| $C_s$ | — Drift. |
| hvt | — Elevation angle increment; i.e., vertical angular difference between $Al_1$ and $Al_2$. |
| U | — Superelevation; i.e., increment to elevation angle of weapon barrel axis that is required to compensate for the effect of gravity upon the projectile trajectory. |
| ts | — Flight time of the projectile. |
| ssv | — Azimuth scale angle (equal to $sv_1 + C_s$ . svt). |
| E | — Elevation angle of weapon barrel (equal to $hv_1$ + hvt + U). |

-continued

| | Geometrical and Ballistic Designations Illustrated in FIGS. 3–6 |
|---|---|
| W | — Wind velocity in meters per second. |
| baW | — Wind direction. |
| $\Delta V_o$ | — Disturbance in projectile muzzle velocity. |
| $\Delta\delta$ | — Departure of air temperature and pressure from standard. |
| F | — The total speed of the target. |

It is assumed in the following description that the leveling and parallel orientation of the gun, the parallax field measurements and the other preparations for firing have been correctly performed, so that the magnitudes Ahp, Hp, and bap (see FIG. 4) have been accurately established and have been fed into the calculating apparatus of the instrument center by correct settings of manually adjustable input instrumentalities. It is further assumed that a target aircraft has been caught in the central sight in the instrument center by aiming of the periscope 5, that the sight is being generally kept on the target by means of its tracking servo (the switch 51 being closed), and that fine corrections for tracking accuracy are being made manually with the aid of cross hairs on the optical sight. If live ammunition is being used, a double-throw switch 50 is in its position shown in FIG. 6. The calculating apparatus at the instrument center calculates the position of the aiming-off point Ffp in relation to the instrument center, and further, calculates a parallax correction and issues an output to the weapon servo means 8 by which the weapon is aimed at the aiming-off point.

For the calculations made at the instrument center during tracking, the control means 40 continunously produces outputs corresponding to the azimuth angle $sv_1$, the target elevation angle $hv_1$, and the direct distance $Al_1$. These outputs are fed to a calculator 41, which employs them to compute the polar velocities $\dot{s}v_1$, $\dot{h}v_1$ and $\dot{Al}_1$ of the target. With the switch 51 closed, a feedback calculation takes place in the calculator 42, the output of which controls the tracking servo mechanism that facilitates tracking with the central sight. The polar velocity outputs of calculator 41 are also fed to a calculator 43 which calculates the velocity vectors $\dot{Ah}_1$, $\dot{At}_1$ and $\dot{H}_1$ of the target.

A calculator 44 at the instrument center calculates those magnitudes that are peculiar to a real projectile fired from the weapon 1, namely projectile flight time *ts*, drift $C_s$ and the super-elevation U of the gun barrel. For this the calculator 44 receives inputs corresponding to $\Delta V_o$ and $\Delta\delta$ (as defined above), which inputs may be obtained from manually controlled instrumentalities, and it also receives from the control means 40 an input corresponding to the distance $Al_1$ between the instrument center and the target. The Cs and U outputs of calculator 44 are fed to a calculator 48, the function of which is described below, and from calculator 48 the calculator 44 receives an input corresponding to $Al_2$.

The double-throw switch 50 has two fixed contact terminals, one of which is a blind terminal and the other of which is grounded. The movable contactor of that switch is connected to a permanent connection 50' between calculator 44 and a multiplying calculator 45. When the movable contactor of switch 50 is in its position for real projectile firing — i.e., the position shown in FIG. 6, and connected with the blind terminal — the multiplying calculator 45 receives the ts (projectile flight time) output from calculator 44. During tracking, multiplying calculator 45 constantly receives from the calculator 43 inputs corresponding to target velocity vectors $\dot{A}h_1$, $\dot{A}t_1$ and $\dot{H}_1$, and it multiplies these by the ts magnitude that it receives from the switch 50. The outputs of multiplying calculator 45 (corresponding to $\dot{A}h_1.ts$, $\dot{A}t_1$ $.ts$ and $\dot{H}_1.ts$) are fed to a calculator 47 which mainly performs additions.

Besides its inputs from multiplying calculator 45, the adding calculator 47 also receives from a calculator 46 inputs that correspond to the projected horizontal distance to the target $Ah_1$, and to the projected vertical distance to the target $H_1$, which magnitudes are calculated by a calculator 46 on the basis of $Al_1$ and $hv_1$ inputs to it that it receives from the control means 40. The adding calculator 47 receives further inputs corresponding to vertical parallax Hp, parallax Ahp in the $Ah_1$ direction, bearing bap from the instrument center to the weapon, wind velocity W, and wind direction *baw*, all of which can be produced by manually controlled adjustment devices and constitute increments to Ah, and $H_1$.

The output of adding calculator 47 is fed to the above mentioned computer 48, which also receives from the calculator 44 inputs corresponding to drift Cs and superelevation U, those magnitudes being dependent upon missile flight time *ts*. One output of computer 48 corresponds to the elevation angle E of the weapon barrel. Another, corresponding to the azimuth angle increment *svt*, is added, in an adder 49, to the output of control means 40 that corresponds to azimuth angle $sv_1$, and the output of adder 49 thus corresponds to azimuth scale angle *ssv*. It will be seen that the outputs E and *ssv* correspond to the required aiming elements for aligning the weapon onto the aiming-off point, and those outputs are fed to the aiming servo means 8 for the weapon by way of the cable 3. As mentioned above, calculator 48 also produces an output corresponding to the distance $Al_2$ between the instrument center and the aiming-off point Ffp, which output is fed back to the calculator 44. In the calculator 44 are stored ballistic values of $Al_2$ with the ts output of the calculator 44 as a parameter. The $Al_2$ value from computer 48 is compared with this latter value and the difference is used to control a servo loop that calculates the correct ts value.

The order to begin firing is given to the gun crew officer in charge of the battery, who also decides the duration of each firing sequence. If the gun has been properly levelled and paralleled, and if all of the input data to the calculating apparatus are correct, including parallax data obtained from field measurements as well as data obtained from target tracking, then the result of a firing with real projectiles should be a hit on the target.

During practice firing with laser emissions from the unit 14, the double-throw switch 50 at the instrument center is set to its position opposite to that shown in FIG. 6, in which it grounds the ts output of calculator 44 and also the ts input of multiplying calculator 45. As a result, the multiplying calculator 45 then receives an input corresponding to $ts=0$, signifying the substantially zero projectile flight time of a laser emission. Accordingly the multiplying calculator 45 multiplies the target speed vectors by zero, so that the aiming-off point Ffp is calculated to coincide with the actual instantaneous position of the target. Since drift $C_s$ and superelevation U are dependent upon missle flight time *ts*, those magnitudes are also set at zero by the placement of switch 50 in its grounded laser-practice position. Obviously the manual wind velocity setting is adjusted to zero for laser emission practice.

If the guns have been properly levelled and paralled, and if parallax field measurements have been accurately made, every gun in the battery will be aimed at the same point as the central sight at the instrument center. Hence if all preparations for firing have been accurately performed, and if tracking is likewise accurate, every gun should be able to record a hit. If one particular gun in the battery has been inaccurately levelled or paralleled, or is the subject of inaccurate parallax measurements, the simulated firing results obtained with it will be conspicuously out of line with those obtained with the other guns. This follows from the fact that the laser detector at each weapon responds only to the reflected laser pulse emissions from its own associated emitter.

Selection is made of the minimum number of pulses which must be detected for scoring of a hit on the basis of the available technical data concerning the laser apparatus and the circumstances under which the apparatus is to be used, including the accuracy with which the weapon system is assumed to be operated for actual firing. To accomodate imperfections in the laser radiation and detection systems, that minimum number of detected pulses should not be nearly as high as the number of pulses in an emitted pulse train. On the other hand, if a suitably rigorous requirement for accuracy is to be imposed, so that the results obtained during laser practice will not be more favorable than would be achieved in corresponding firing of real projectiles, the minimum must be higher than one or a relatively few pulses.

The number of pulses in an emitted pulse train should also be determined with due regard to conditions of use of the apparatus. The laser system can be influenced by environmental conditions, and especially by atmospheric disturbances, which can cause a few pulses of a pulse train to be lost in the course of out-and-back travel, or cause false pulses to be produced, as by sun glints or lightning flashes. To minimize the effects of such disturbances upon scoring, each emitted pulse train corresponding to a shot should desirably comprise a fairly large number of pulses, preferably at least 10. On that basis, the limit between a "hit" and a "miss" can be set at a number equal to at least half of the emitted pulses of a train. The emitted pulse train should not contain an unduly large number of pulses, for otherwise the intervals between successive pulse trains become too short and processing of detected pulses becomes unduly complicated.

It will be evident that the example illustrated in FIGS. 9 and 10, wherein a train of sixteen pulses is emitted for each simulated shot and at least eight pulses of a train must be detected for scoring a hit, represents a system that will be compatible with existing laser apparatus, will be relatively immune to disturbance from external conditions, and will therefore afford good scoring accuracy.

Up to this point in the explanation it has been assumed that a hit will actually be indicated and scored each time at least the required minimum number of pulses is detected. Practice results could of course be scored on that basis, and such scores would provide some indication of the relative state of training of the personnel achieving them. However, the scores thus obtained would not correspond to the hit results that the same personnel would achieve when firing real projectiles under the same circumstances, owing to three significant differences between the firing of real projectiles and simulated firing with the use of laser emissions:

First, the dynamic errors in alignment of the guns in relation to the tracking movements of the central sight will be smaller for simulated firing with laser emissions than for real firing, owing to the effectively zero projectile flight time employed for laser emissions whereby the aiming-off point is caused to coincide with the point on which the central sight is aimed.

Second, a hit is scored when the target aircraft and its reflector are located within the sensitivity lobe defined by the radiation emitter and detector, so that the laser apparatus accepts comparatively large sighting errors, and accepts increasingly large sighting errors at longer ranges, in direct opposition to the situation that obtains with the firing of real projectiles.

Third, in the firing of real projectiles there is a distance-dependent random spread of projectile trajectories whereby the probability of a hit decreases with increasing range, whereas no such random departure occurs with radiation emissions.

It will be noted that all three of these factors influence scoring results in the same direction; that is, they tend to cause excessively high scores to be made with laser emissions as compared with the scores that would be made in real firing under equivalent circumstances. It will also be apparent that two of the three factors which control the difference between real and simulated scoring are unpredictable in magnitude, except on a probability basis.

In order to obtain a more objective and realistic scoring of results obtained during target practice with laser emissions, in cases where shots are fired in salvo — i.e., a plurality of projectiles are fired in rapid succession — a logic processing of the hit-and-miss results is preferred, whereby proper account is taken of the several differences between real firing and simulated firing with laser emissions and of the probability factors involved in those differences. The apparatus by which this logic processing is performed is designated by 34 in FIG. 2 and is illustrated in more detail in FIG. 11.

As described above, the radiation detector 33 responds to detected radiation pulses corresponding to an emitted pulse train, to issue either a nominal hit output T or no output M, the latter signifying a miss. The output of the detector 33 is fed to a hit/miss shift register 52 which is connected with a hit sequence evaluator 53. The logic processing apparatus also comprises a laser ranging calculator 54 which is connected with both the detector 33 and with the laser beam emitter 24. The range R (weapon-to-target distance) is calculated in a known manner in the range calculator 54, on the basis of the time required for the out-and-back travel of an emitted pulse, and for each nominal hit the range outout of the calculator 54 is fed to a range shift register 55. The two shift registers 52 and 55 are connected with a hit probability table memory 56 of the so-called ROM type. The memory 56 and a random numbers generator 57 are connected with a comparator 58, and the output of the comparator is used for scoring purposes.

Clock pulses $k$ are generated in bursts, under control of the laser emitter 24. The clock pulses are fed to the range calculator 54, to the shift registers 52 and 55, to the random generator 57 and to the comparator 58.

In general, the apparatus illustrated in FIG. 11 serves to allot to each nominal hit signalled by the detector 33 a "hot points" value that is selected in dependence upon the dynamic tracking accuracy of the gun in relation to the central sight and upon the range calculated by the laser ranging computer 54. The hit points thus obtained constitute a measurement of the probability that any particular nominal hit could have corresponded to a real hit on the target had a real projectile been fired. The several hit point evaluations obtained for a succession of simulated shots in a firing sequence are then subjected to a random treatment which yields a determination of the probable hit result of the whole firing sequence.

The logic apparatus can now be considered in more detail, with reference to FIGS. 12–15, which tabulate data assumed to have been obtained from a simulated salvo or firing sequence consisting of 24 successive shots or laser pulse trains. Information on the hit-or-miss results T/M for each of these shots is fed into the hit/miss shift register 52; and information as to the range distance R for each shot that produced a nominal hit is fed into the range shift register 55 from the range calculator 54.

On the basis of the clock frequency $k$, each shot is assigned a number $n$ in the sequence of shots, for identification purposes in the logic processing. The information stored in the hit/miss register 52 enables an evaluation to be made of each nominal hit in a salvo of shots, on the basis of results of shots in a short sequence immediately prior to that shot and a short sequence immediately following it. That evaluation is made in the hit sequence evaluator 53, which produces, for each shot of a fired salvo, an output $f$ that corresponds to a hit pattern value for that shot. The number of shots before a particular shot and the number of shots after it that are taken into account for the determination of the hit pattern value depends upon the time constant for an ordinary aiming-off calculation made by the instrument center, multiplied by the shot frequency. FIG. 13 illustrates how the hit pattern value $f$ is calculated for the shot numbered 17. Taking the time constant as 0.75 sec. and the shot frequency as 4 shots/sec., three shots on either side of the one to be evaluated are considered in making the evaluation. Each of those "neighboring" shots is assigned a zero co-action pattern value $\Delta f$ if it represents a miss, or, if it represents a nominal hit, it is assigned a $\Delta f$ value that depends upon its nearness in time to the hit being evaluated. The hit pattern value $f$ for shot No. 17 is obtained by adding the coaction pattern values $\Delta f$ for the three shots immediately preceding No. 17 and the three immediately following it. Thus the hit pattern value of a given nominal hit takes account of the fact that said nominal hit is more likely to represent a real hit if the shots fired nearest in time to it were also nominal hits.

At the same time that the hit pattern value $f$ is obtained, there is determined for each hit of the shot sequence a distance value $a$ that depends upon the weapon-to-target distance at the instant of the simulated shot. Such determination of the distance value is made in the range shift register 55, on the basis of a tabulation which is programmed into the register and which is illustrated in FIG. 14.

On the basis of the hit pattern value f and the distance value $a$ for each nominal hit, a hit point value P for the hit is determined in the table memory 56. The tabulation stored in that memory is illustrated, in part, in FIG. 15. The hit point number in the illustrated case has a numerical value between 0.00 and 1.00 and represents the probability that a given nominal hit would represent an effective hit on the target. The table illustrated in FIG. 15 is based on a normal distribution of the projectile trajectory spread, a known or arbitrarily assumed circular target area, and the dimensions of the radiation lobe. The tabulation is further based upon an assumed linear relationship between the hit pattern value and the miss distance, said relationship being so chosen that a hit pattern value of seven corresponds to a zero miss distance and a hit pattern value of zero corresponds to a miss distance equal to the diameter of the radiation lobe.

The hit point number output obtained from the table memory 56 represents a probability that a particular nominal hit would correspond to an effective hit, but of course it does not yield a definite decision as to whether or not that particular nominal hit should be scored as a hit. In effect, that decision is made by the comparator 58 in cooperation with the random numbers generator 57. For each nominal hit the random numbers generator issues an output corresponding to a randomly chosen number S between 0.000 and 1.00, with a uniform probability distribution for the several numbers that can thus be issued. In the comparator 58, the hit point output P for each nominal hit, issued by the hit point evaluator 57, is compared with the random number S for that shot, issued by the random generator 57; and if the hit point value is lower than the random number, the output V of comparator 58 will be zero, signifying a miss. If the hit point value P for a particular shot equals or exceeds the value of the random number S issued for that shot, the output V of the comparator 58 will be a "one", and a hit will be scored, corresponding to an actual effective hit.

It will be observed that by reason of the random number generation and comparison treatment, the probability that a given nominal hit will be scored as an effective hit is as high as the hit point value P for that nominal hit; whereas without this feature of the processing, the evaluation would be unfavorable for hits at long shooting ranges.

For purposes of review of a tactical exercise, the logic processing of the simulated hit-miss registrations is preferably printed out in a form exemplified by FIG. 12, a suitable printer being connected with the logic unit 34 for that purpose.

It will be apparent that the particulars of the logic processing can be varied in certain respects without departing from the spirit of the invention. As one such alternative, instead of the random treatment described above, the hit points P obtained with a succession of simulated shots can be added to one another to obtain a sum which is the equivalent of the statistical expectation of the number of effective actual hits on the target.

From the foregoing description taken with the accompanying drawings it will be apparent that this invention provides apparatus for antiaircraft gunnery practice with the use of laser emissions instead of real projectiles, which apparatus produces scoring results accurately corresponding to the results that would be achieved with the firing of real projectiles under equivalent circumstances. It will also be apparent that the apparatus of this invention has notable training value not only because it provides an accurate and reliable evaluation of the performance of antiaircraft personnel, so that they are encouraged to carry out a simulated exercise with all of the precision and efficiency that they would devote to a real firing, but also because — as in actual firing — it enables them to be informed almost immediately of the results that they have achieved with any particular salvo of shots.

Those skilled in the art will appreciate that the invention can be embodied in forms other than as herein disclosed for purposes of illustration.

The invention is defined by the following claims:

1. In apparatus for controlling the aiming of an antiaircraft weapon having a barrel axis and a firing mechanism, and which apparatus comprises target tracking means located at a distance from the weapon for producing outputs corresponding to the instantaneous position of a target and to its speed and direction of motion, projectile flight time means for producing an output corresponding to the calculated time required for a projectile fired from the weapon to traverse the distance from it to the target, aim calculation means having an input connection from said target tracking means and normally having an input connection from said projectile flight time means, for calculating an aiming-off point ahead of the target at which the weapon should be aimed in order for a projectile fired from it to strike the target, and servo means at the weapon, connected with the aim calculation means and by which the weapon is aimed, means for scoring firing preparation and the accuracy of tracking during simulated firing of the weapon, the last mentioned means comprising:

A. laser means at the weapon for emitting radiation pulses along an axis substantially coinciding with the barrel axis;

B. means at the weapon connected with its firing mechanism and with said laser means, for causing the laser means to emit a pulse train comprising a predetermined succession of pulses of radiation each time the firing mechanism is actuated for the simulated firing of a projectile, each said pulse train containing a predetermined number of pulses and having a duration substantially shorter than the normal time between successive firings of real projectiles;

C. radiation detection means at the weapon for detecting emitted radiation reflected back along said axis from reflector means on a target;

D. means for producing a perceptible scoring output in response to reception by said radiation detection means of a succession of pulses comprising a predetermined substantial portion of the pulses of a pulse train;

E. manually controllable means by which said aim calculation means can be 1. disconnected from the projectile flight time means, and
2. connected instead, for simulated firing, with a source of an input that corresponds to a projectile flight time equal to zero, so that proper preparation and tracking causes the weapon to be aimed directly at a tracked target at each instant of simulated firing and thus enables the radiation detection means to receive substantially the entire train of pulses emitted at each simulated firing and reflected back from the target.

2. The apparatus of claim 1, further characterized by:

F. said reflector means on the target being so arranged that radiation from the laser means radiated to said reflector means, is reflected back to the detector means when the target is aligned with the barrel axis at an instant of simulated firing of the weapon.

3. In apparatus for controlling the aiming of an anti-aircraft weapon having a barrel axis, a firing mechanism that is operated for each firing of a real projectile and is likewise operated during simulated firing, and laser means connectable with the firing mechanism for emitting radiation substantially along the barrel axis at each operation of the firing mechanism during simulated firing and for detecting such of the radiation as is reflected back from reflector means on a target, and which apparatus comprises target tracking means located at a distance from the weapon for producing outputs that depend upon the movements of a tracked target and the accuracy with which the target is tracked, projectile flight time calculating means for producing an output corresponding to the calculated time required for a real projectile fired from the weapon to traverse the distance from it to a tracked target, aim calculation means having an input connection from said target tracking means for calculating an aiming-off point which is ahead of the target and at which a real projectile should be fired in order to strike the target, and servo means at the weapon connected with the aim calculation means and by which the weapon is aimed, means for enabling said apparatus to be employed both for the firing of real projectiles and for simulated firing of the weapon with radiation emissions from said laser means to enable scoring of firing preparations and accuracy of tracking, the last mentioned means comprising:

a. a manually adjustable control element which can be alternately disposed in either of a pair of positions and which is at all times connected with the aim calculation means for feeding inputs thereto, said element being further so connected in said apparatus that
   1. in one of its said positions said element connects the aim calculation means with the projectile flight time calculating means so that the aim calculation means can receive an input from the projectile flight time calculating means that enables the weapon to be correctly aimed for the firing of real projectiles, and
   2. in the other of its said positions the control element connects the aim calculating means with a source of another input that corresponds to a zero missile flight time, so that with accurate tracking and proper firing preparations the weapon is aimed directly at a tracked target and radiation emitted from the laser means can be reflected back to the same from a reflector on the target; and b. said laser means comprises a radiation emitter and a radiation receiver, the latter being responsive to radiation from the emitter that is reflected back along the barrel axis, said apparatus being further characterized by:
   1. The emitter comprising means connected with the firing mechanism to cause a predetermined number of rapidly successive pulses of radiation to issue at each operation of the firing mechanism; and
   2. detector means connected with the radiation receiver and comprising counting means, arranged to issue a hit scoring output only when said receiver receives a predetermined minimum number of radiation pulses of an emitted succession thereof, said minimum number being more than two but substantially less than said predetermined number of pulses issued by the emitter.

4. The apparatus of claim 3 wherein said predetermined minimum number of pulses is on the order of one-half of said predetermined number of pulses issued by the emitter.

5. The method of scoring target practice with a weapon which is adapted to fire simulated shots in salvos, each salvo comprising a plurality of shots that succeed one another at short, regular time intervals, and wherein shots at a target having a reflector are simulated by means of laser radiations directed towards the target from the weapon, and the results of each shot are signified by an output, said output being a hit output if at least a predetermined substantial portion of the radiation emitted for the shot is found to have been reflected back to the weapon from the target but being otherwise a miss output, said method being characterized by:

A. preserving information concerning the outputs obtained for successive shots of a salvo, in such a manner that for each preserved hit output other than at the ends of the salvo there are simultaneously available the preserved outputs for a predetermined number of its immediately preceding shots and a like number of its immediately following shots;

B. with the use of the preserved information, assigning to each said hit output a hit pattern value which is the sum of values assigned to said immediately preceding and succeeding outputs on the basis that
   1. a zero value is assigned to such of its said preceding and succeeding outputs as are miss outputs, and
   2. the value assigned to each of said preceding and succeeding outputs that is a hit output varies directly with its proximity to said hit output;

C. determining the distance between the weapon and the target at the instant each hit output is obtained; and D. for each hit output, calculating a hit probability value which is in a predetermined direct relationship to the hit pattern value assigned to the hit output and in a predetermined inverse relationship to said distance.

6. The method of claim 5 wherein the hit probability value assigned to every hit output lies within a predetermined range of numbers, further characterized by:

E. generating, for each hit output, a random number taken from said range of numbers and with a uniform distribution of probabilities for the numbers in said range;

F. comparing the hit probability value for each hit output with the random number generated for that hit output; and G. issuing a definitive hit scoring output only if a hit probability value is at least as great as a random number with which it is compared.

7. The method of claim 5, further characterized by:

1. for each simulated shot, emitting laser radiations in a predetermined number of pulses in a rapid succession, which succession terminates a substantial time before a succeeding simulated shot is fired; and
2. issuing a hit output for a simulated shot only upon detection of at least a predetermined minimum number of reflected-back pulses of that simulated shot, said minimum number being on the order for one-half of said predetermined number of emitted pulses.

8. The method of simulating the firing of a weapon having a barrel by means of narrow-beam radiation emitted from a laser at the weapon location along a radiation axis that has a predetermined relationship to the axis of said barrel, and scoring the results obtained with such simulated firing by detecting, with a detector at the weapon, radiation reflected back along said radiation axis from a reflector on a target at which the weapon is fired, which method is characterized by:

A. for each simulated shot fired from the weapon, causing a predetermined number of pulses or radiation to be emitted from the laser, said pulses being emitted in rapid succession, and the succession of pulses that simulates each shot terminating a substantial time before the beginning of the succession of pulses which simulates the next successive shot; and B. issuing a hit output from said detector only when the number of reflected and detected pulses for a simulated shot is a predetermined minimum, which minimum is more than one but substantially less than the number of pulses in the succession for the simulated shot.

9. The method of claim 8 wherein said predetermined number of pulses is at least four and said minimum is substantially equal to one-half of said predetermined number of pulses.

* * * * *

UNITED STATES PATENT OFFICE

CERTIFICATE OF CORRECTION

PATENT NO. : 3,955,292

DATED : May 11, 1976

INVENTOR(S) : Hans R. Robertsson

It is certified that error appears in the above-identified patent and that said Letters Patent are hereby corrected as shown below:

Column 2, line 59: "or" should read --of--
Column 12, line 3: "hot points" should read --hit points--
Column 17, line 1: "of" should read --for-- (second occurrence)
Column 17, line 2: "for" should read --of--
Column 17, line 15: "or" should read --of--

Signed and Sealed this

Seventh Day of September 1976

[SEAL]

*Attest:*

RUTH C. MASON
*Attesting Officer*

C. MARSHALL DANN
*Commissioner of Patents and Trademarks*